US006042655A

United States Patent [19]

Hara et al.

[11] Patent Number: 6,042,655

[45] Date of Patent: Mar. 28, 2000

[54] CYLINDER CLEANING METHOD

[75] Inventors: Akira Hara, Tokyo; Hiraku Onuma, Yokohama; Takashi Ichihara, Komae, all of Japan

[73] Assignee: Baldwin-Japan Ltd., Tokyo, Japan

[21] Appl. No.: 09/009,207

[22] Filed: Jan. 20, 1998

[30] Foreign Application Priority Data

Jan. 22, 1997 [JP] Japan ..... 9-024225

[51] Int. Cl.[7] ..... B08B 7/00; B41F 35/06; B41L 41/06

[52] U.S. Cl. ..... 134/6; 134/32; 134/33; 134/42; 101/423; 101/424; 101/425

[58] Field of Search ..... 134/6, 32, 33, 134/42; 101/423, 424, 425

[56] References Cited

U.S. PATENT DOCUMENTS

| | | | |
|---|---|---|---|
| 4,344,361 | 8/1982 | McPhee et al. | 101/425 |
| 5,275,104 | 1/1994 | Corrado et al. | 101/425 |
| 5,328,116 | 7/1994 | Hishinuma et al. | 242/543 |
| 5,368,157 | 11/1994 | Gasparrini et al. | 206/209 |

FOREIGN PATENT DOCUMENTS

| | | |
|---|---|---|
| 0 520 521 A1 | 12/1992 | European Pat. Off. . |
| 0 570 676 A1 | 11/1993 | European Pat. Off. . |
| 2 636 268 A1 | 11/1990 | France . |
| 195 08 569 A1 | 11/1995 | Germany . |

*Primary Examiner*—Zeinab El-Arini
*Attorney, Agent, or Firm*—Morgan & Finnegan, LLP

[57] ABSTRACT

A method of cleaning the outer surface of a cylinder by using a cleaning fabric intermittently fed from a supply, and engaged with and pressed against the outer surface of the cylinder. The method includes predetermining periods for each of which the cleaning fabric is engaged with the outer surface of the cylinder a time so that at least some of the periods are different in length from other periods in a cleaning cycle.

11 Claims, 7 Drawing Sheets

CYLINDER CLEANING METHOD

BACKGROUND OF THE INVENTION

1. Field of The Invention

The invention relates to a method of cleaning the outer surface of a cylinder in an offset printing press, such as a blanket cylinder, an impression cylinder, a plate cylinder, or an inking cylinder. More particularly, the invention relates to a method of cleaning the outer surface of a cylinder by using a cleaning fabric intermittently or continuously fed from a supply, and engaged with and pressed against the outer surface of the cylinder.

2. Description of Related Art

There has been generally used a device for cleaning the outer surface of a cylinder in an offset printing press, as disclosed in U.S. Pat. No. 4,344,361. The device comprises an expandable pad opposed to the outer surface of the cylinder and mounted on a frame. A cleaning fabric is directed to a take-up roll from a supply roll through the pad. The take-up roll is intermittently rotated to take up the cleaning fabric so that the cleaning fabric is intermittently fed to the pad from the supply roll. The cleaning fabric is intermittently engaged with and pressed against the outer surface of the cylinder by the pad which is inflated by air under pressure whenever the cleaning fabric is intermittently fed, to clean the outer surface of the cylinder. The cleaning fabric is nipped between the pad and the cylinder within a stripe range having a nip width in the feeding direction of the cleaning fabric.

In the device, it is customary that the cleaning fabric is engaged with the outer surface of the cylinder for a constant period a time, throughout a cleaning cycle for accomplishing the cleaning of a cylinder. In addition, the cleaning fabric is fed for a length a time which corresponds to the nip width of the cleaning fabric, throughout the cleaning cycle. For example, the cleaning fabric is nipped between the pad and the cylinder within a stripe range having a nip width of about 5 to 8 mm. Accordingly, the cleaning fabric is fed for a length of about 5 to 8 mm every three rotations of the cylinder. The cleaning fabric is fed twenty times in the cleaning cycle so that it consumes the cleaning fabric of about 100 to 160 mm. The used fabric is then taken up about the take-up roll for disposal.

By the way, the cylinder is made clean more and more in accordance with the progress of cleaning toward the end of the cleaning cycle. Accordingly, the cleaning fabric is made heavily dirty and saturated with dirt only at the beginning of the cleaning cycle. The cleaning fabric gradually decreases in degree of the dirt in accordance with the progress of cleaning toward the end of the cleaning cycle. As to the latter half in length of the cleaning fabric used in the cleaning cycle, it is little dirty and still available to clean the outer surface of the cylinder. Accordingly, it is wasteful of cleaning fabric to dispose it in spite of the availability thereof.

There has been also used a device for cleaning the outer surface of a cylinder in an offset printing press, in which the cleaning fabric is not intermittently but continuously fed from a supply, and engaged with and pressed against the outer surface of the cylinder to clean the outer surface of the cylinder. In the device, it is customary that the cleaning fabric is fed at a constant speed, throughout the cleaning cycle. Accordingly, the used fabric includes a substantial portion which is little dirty and still available to clean the outer surface of the cylinder. It is wasteful of cleaning fabric to dispose it in spite of the availability thereof.

In addition, there has been heretofore proposed a cleaning fabric which has a cleaning agent or detergent previously impregnated thereinto, as disclosed in U.S. Pat. No. 5,368,157. The cleaning fabric may alternatively have a cleaning agent or detergent in the form of jelly or paste applied onto the cleaning fabric. A cleaning agent or detergent may be received in a receptacle which is mounted on the printing press so that the cleaning fabric is directed into the receptacle from the supply roll and then fed to the pad. The cleaning agent or detergent is impregnated into the cleaning fabric when the cleaning fabric is directed into the receptacle. The cleaning agent or detergent may be sprayed onto and impregnated into the cleaning fabric by nozzles mounted on the printing press, as disclosed in U.S. Pat. No. 4,344,361. In the cases, it is wasteful of not only cleaning fabric but also cleaning agent or detergent to dispose it in spite of the availability thereof.

It is therefore an object of the invention to provide a new and improved method of cleaning the outer surface of a cylinder by using a cleaning fabric intermittently or continuously fed from a supply, and engaged with and pressed against the outer surface of the cylinder, to thereby overcome the above problems.

Another object of the invention is to eliminate the waste of cleaning fabric.

Other object of the invention is to eliminate the waste of not only cleaning fabric but also cleaning agent or detergent.

SUMMARY OF THE INVENTION

According to the invention, there is provided a method of cleaning the outer surface of a cylinder by using a cleaning fabric intermittently fed from a supply, and engaged with and pressed against the outer surface of the cylinder. The method comprises predetermining periods, for each of which the cleaning fabric is engaged with the outer surface of the cylinder, so that at least some of the periods are different in length from other periods in a cleaning cycle.

The cleaning fabric may have a cleaning agent or detergent impregnated into or applied onto the cleaning fabric.

The cleaning fabric may be pressed against the outer surface of the cylinder by pad means, the cleaning fabric being nipped between the pad means and the cylinder within a stripe range having a nip width in the feeding direction of the cleaning fabric. The method may further comprise feeding the cleaning fabric for a length which is less than the nip width of the cleaning fabric.

In a preferred embodiment, the periods are gradually lengthened in accordance with the progress of cleaning from start to end of the cleaning cycle.

The periods may be divided into a plurality of groups and gradually lengthened group by group from start to end of the cleaning cycle.

The number of times of feeding the cleaning fabric per second or minute may be gradually decreased group by group from start to end of the cleaning cycle.

Relatively shorter periods may be applied to a portion or the whole of the substantially first half in length of the cleaning fabric used in the cleaning cycle.

There is also provided a method of cleaning the outer surface of a cylinder by using a cleaning fabric intermittently fed from a supply, and engaged with and pressed against the outer surface of the cylinder by pad means, the cleaning fabric being nipped between the pad means and the cylinder within a stripe range having a nip width in the feeding direction of the cleaning fabric. The method comprises feeding the cleaning fabric for a length which is less than the nip width of the cleaning fabric.

The cleaning fabric may have a cleaning agent or detergent impregnated into or applied onto the cleaning fabric.

The cleaning fabric may be engaged with the outer surface of the cylinder for a constant period a time.

There is further provided a method of cleaning the outer surface of a cylinder by using a cleaning fabric continuously fed from a supply, and engaged with and pressed against the outer surface of the cylinder. The method comprises the step of predetermining the feeding speed of the cleaning fabric engaged with the outer surface of the cylinder so that the feeding speed is gradually changed in a cleaning cycle.

The cleaning fabric may have a cleaning agent or detergent impregnated into or applied onto the cleaning fabric.

In a preferred embodiment, the feeding speed is continuously changed in accordance with the progress of cleaning from start to end of the cleaning cycle and continuously lowered at least in a portion of the cleaning cycle.

The feeding speed may be changed step by step in accordance with the progress of cleaning from start to end of the cleaning cycle and lowered step by step at least in a portion of the cleaning cycle.

The feeding speed may be lowered with a plurality of gradients which are increased in accordance with the progress of cleaning from start to end of the cleaning cycle.

The feeding speed may be increased with respect to a portion or the whole of the substantially first half in length of the cleaning fabric used in the cleaning cycle and lowered with respect to the residual of the cleaning fabric used in the cleaning cycle.

DETAILED DESCRIPTION OF THE PREFERRED EMBODIMENTS

Figure 1:
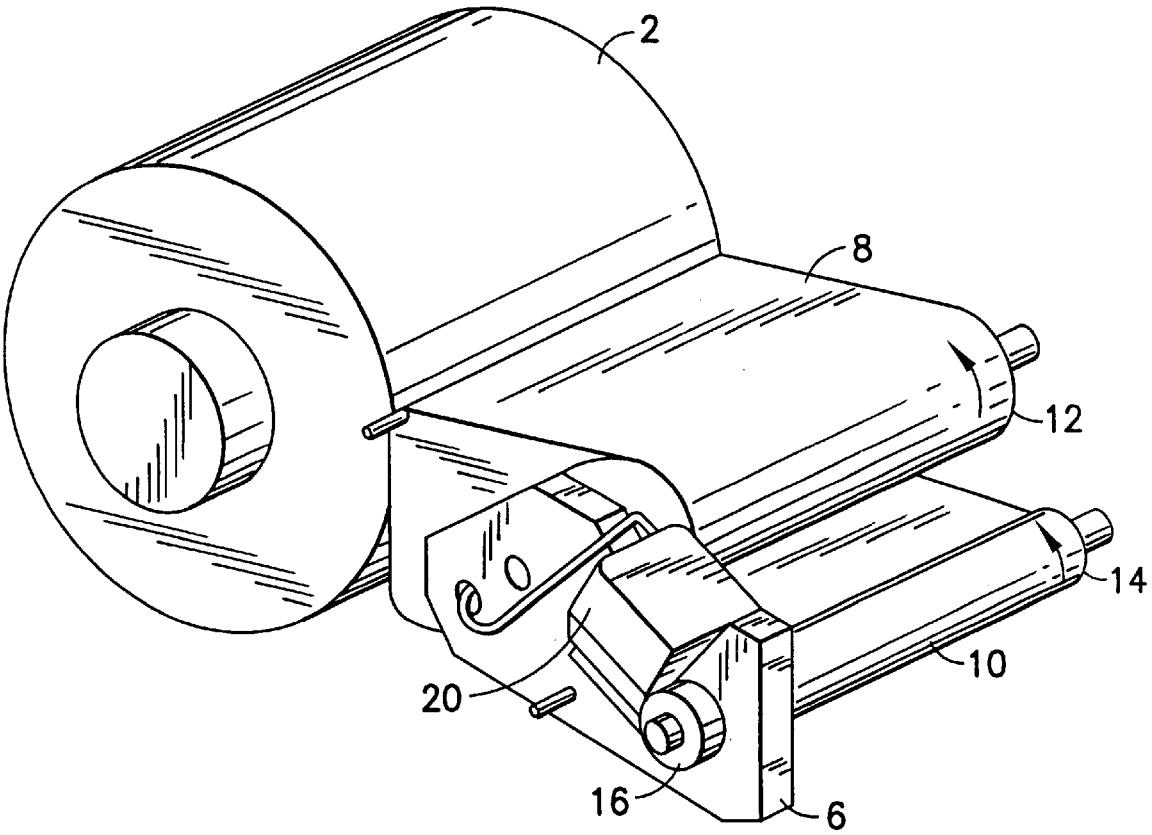
FIG. 1 is a perspective view of a device for cleaning the outer surface of a cylinder by a method according to the invention.
Figure 2:
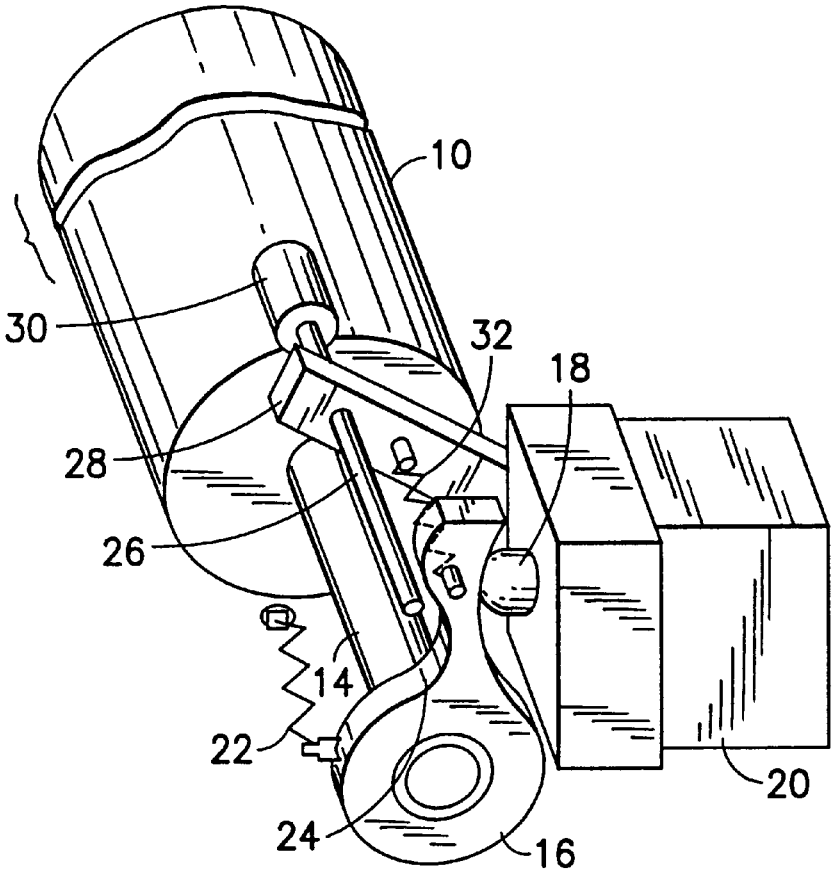
FIG. 2 is a perspective view of a cleaning fabric feeding means in the device of FIG. 1.
Figure 3:
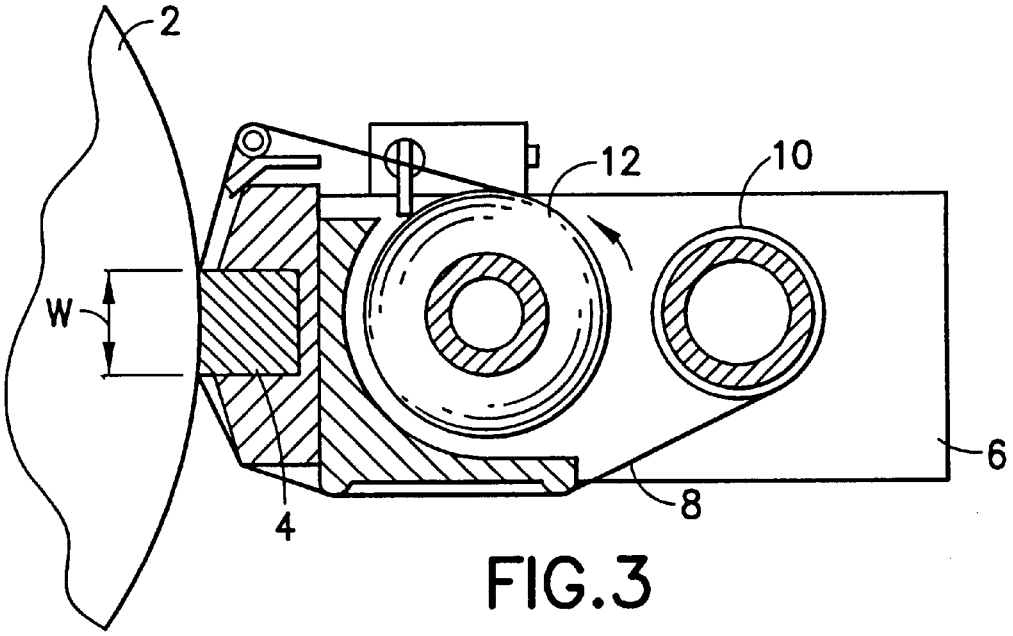
FIG. 3 is a side view of the device of FIG. 1.

Turning now to the drawings, FIG. 1 illustrates a device for cleaning the outer surface of a cylinder 2 by a method according to the invention. The device comprises a pad means 4 opposed to the outer surface of the cylinder 2 and mounted on a frame 6, as shown in FIG. 3. A cleaning fabric 8 is directed to a take-up roll 10 from a supply roll 12 through the pad means 4. The take-up roll 10 includes a shaft 14 on which an arm 16 is mounted through a one-way clutch, as shown in FIG. 2. The arm 16 is pushed and swingingly moved by a rod 18 in an air or hydraulic cylinder 20 and then returned by a spring 22 about the shaft 14 so that the take-up roll 10 and the shaft 14 are intermittently rotated in one direction by the one-way clutch to take up the cleaning fabric 8 whenever the arm 16 is swingingly moved by the rod 18. Accordingly, the cleaning fabric 8 is intermittently fed to the pad means 4 from the supply roll 12.

The arm 16 includes a cam surface 24 which is adapted to be engaged with a stop bar 26 mounted on a lever 28 to restrict the movement of the arm 16. The stop bar 26 includes a roller 30 which is engaged with the outer surface of the take-up roll 10 by a spring 32 connected to the lever 28. Accordingly, the lever 28 is swingingly moved integrally with the stop bar 26 and the roller 30 in accordance with the increase in diameter of the take-up roll 10 so that the stop bar 26 and the cam surface 24 cooperate with each other to keep the length of the cleaning fabric 8 fed a time substantially the same regardless of the increase in diameter of the take-up roll 10.

The cleaning fabric 8 is intermittently engaged with and pressed against the outer surface of the cylinder 2 by the pad means 4 whenever the cleaning fabric 8 is intermittently fed, to clean the outer surface of the cylinder 2. For example, the pad means 4 may comprise an elastic rectangular or round pad. The frame 6 is moved toward the cylinder 2 by drive means such as air or hydraulic cylinder so that the cleaning fabric 8 is intermittently engaged with and pressed against the outer surface of the cylinder 2. The pad means 4 may comprise an expandable pad as disclosed in U.S. Pat. No. 4,344,361. The cleaning fabric 8 is nipped between the pad means 4 and the cylinder 2 within a stripe range having a nip width W in the feeding direction of the cleaning fabric 8.

Figure 7:
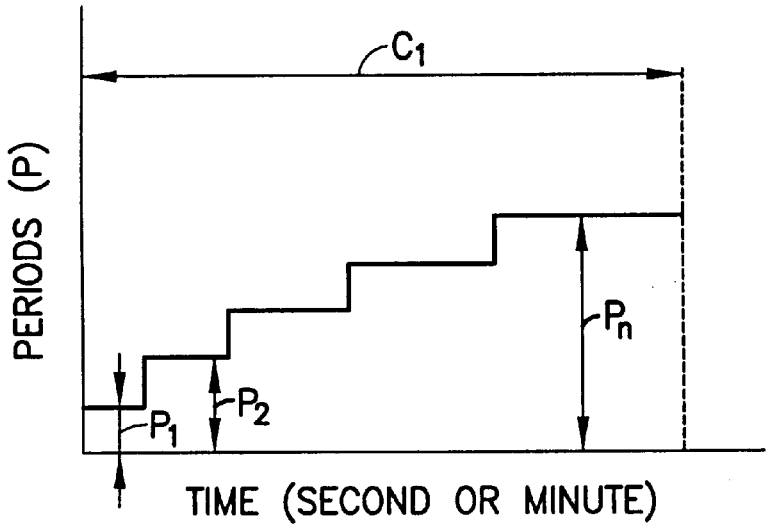
FIG. 7 is a graph showing periods for each of which the cleaning fabric is engaged with the outer surface of the cylinder in one cleaning cycle.

The device is arranged to accomplish the cleaning of a cylinder 2 in a cleaning cycle. The cylinder 2 is made clean more and more in accordance with the progress of cleaning toward the end of the cleaning cycle. Under the circumstances, according to the invention, there is provided a method of cleaning the outer surface of the cylinder 2 to eliminate the waste of cleaning fabric 8. The method comprises predetermining periods P, for each of which the cleaning fabric 8 is engaged with the outer surface of the cylinder 2, so that at least some of the periods P1, P2, . . . Pn are different in length from other periods in the cleaning cycle C1, as shown in FIG. 7.

The cleaning fabric 8 may have a cleaning agent or detergent previously impregnated thereinto, as disclosed in U.S. Pat. No. 5,368,157. The cleaning fabric 8 may have a cleaning agent or detergent in the form of jelly or paste applied onto the cleaning fabric 8. A cleaning agent or detergent may be received in a receptacle which is mounted on the printing press so that the cleaning fabric 8 is directed into the receptacle from the supply roll 12 and then fed to the pad means 4. The cleaning agent or detergent is impregnated into the cleaning fabric 8 when the cleaning fabric 8 is directed into the receptacle. The cleaning agent or detergent may be sprayed onto and impregnated into the cleaning fabric by nozzles mounted on the printing press, as disclosed in U.S. Pat. No. 4,344,361. In the cases, the method can eliminate the waste of not only cleaning fabric 8 but also cleaning agent or detergent.

Figure 4:
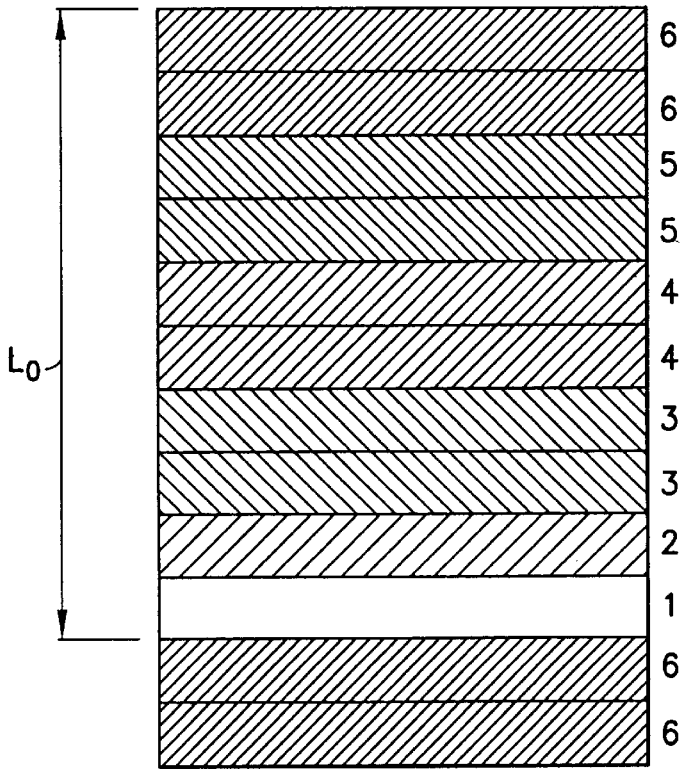
FIG.4 PRIOR ART
FIG. 4 is a schematic view showing the degree of dirt of the used fabric in prior art.
Figure 5:
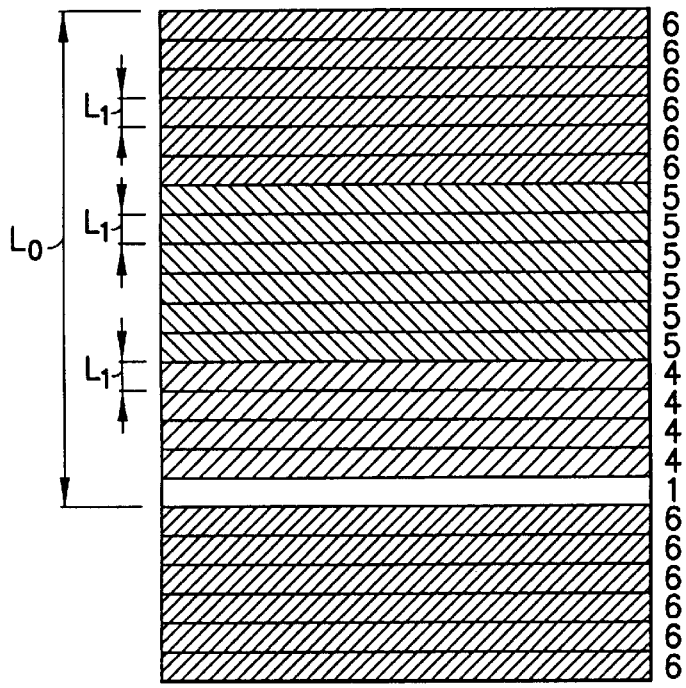
FIG. 5 is a schematic view showing the degree of dirt of the used fabric according to the invention.
Figure 6:
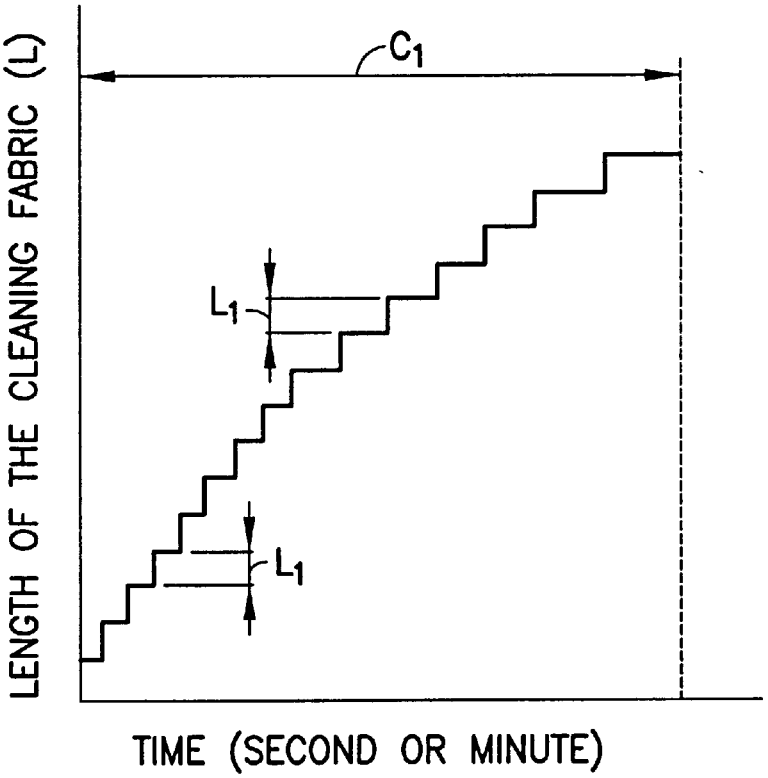
FIG. 6 is a graph showing the length of the cleaning fabric used in one cleaning cycle.

In a preferred embodiment, the method further comprises feeding the cleaning fabric 8 for a length L1 which is less than the nip width W of the cleaning fabric 8, as shown in FIG. 6. In addition, the periods P1, P2, . . . Pn are gradually lengthened in accordance with the progress of cleaning from start to end of the cleaning cycle C1. Accordingly, in comparison with the prior art shown in FIG. 4, the cleaning fabric 8 is made considerably dirty throughout the cleaning cycle C1, as shown in FIG. 5. Numbers 1 to 6 in FIG. 4 and FIG. 5 represent the degree of dirt of the cleaning fabric 8. This decreases the total of lengths L0 of the cleaning fabric 8 used in one cleaning cycle C1 and eliminates the waste of cleaning fabric 8 and cleaning agent or detergent.

In the embodiment, the air or hydraulic cylinder 20 is merely required to feed the cleaning fabric 8 for a short length L1, The air or hydraulic cylinder 20 can therefore be considerably miniaturized. The cleaning fabric 8 can be intermittently and forcibly fed even when nipped between the pad means 4 and the cylinder 2.

In addition, the number of times of feeding the cleaning fabric 8 per second or minute is gradually decreased in accordance with the progress of cleaning from start to end of the cleaning cycle C1. In this connection, the number of times of feeding the cleaning fabric 8 per second or minute can be conveniently increased at the first stage of the cleaning cycle C1 to supply enough cleaning agent or detergent to effectively clean the outer surface of the cylinder 2, without the waste of cleaning agent or detergent. This can save time for cleaning the outer surface of a cylinder 2.

Figure 8:
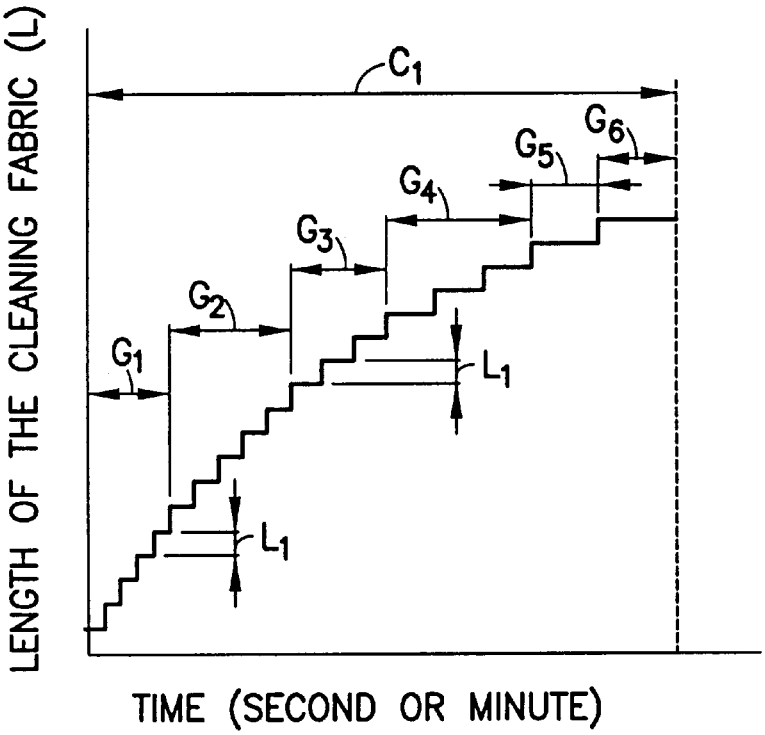
FIG. 8 is a graph showing the length of the cleaning fabric in other embodiment.

In another embodiment, the periods P are divided into a plurality of groups G1 to G6 and gradually lengthened group by group from start to end of the cleaning cycle C1, as shown in FIG. 8. Accordingly, the number of times of feeding the cleaning fabric 8 per second or minute is gradually decreased group by group from start to end of the cleaning cycle C1.

Figure 9:
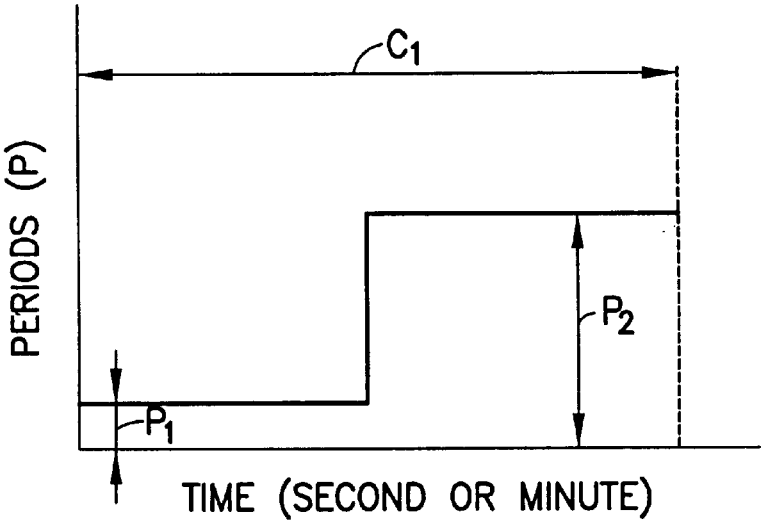
FIG. 9 is a graph showing the periods in other embodiment.

In other embodiment, relatively shorter periods P1 are applied to a portion or the whole of the substantially first half in length of the cleaning fabric 8 used in the cleaning cycle C1, as shown in FIG. 9. Relatively longer periods P2 are applied to the residual of the cleaning fabric 8 used in the cleaning cycle C1. In this embodiment, it is convenient to programmedly control the pad means 4 and the take-up roll 10 to achieve the object.

It can be expected to eliminate the waste of cleaning fabric 8 and cleaning agent or detergent by the step of feeding the cleaning fabric 8 for a length L1 which is less than the nip width W of the cleaning fabric 8, even if the cleaning fabric 8 is engaged with the outer surface of the cylinder 2 for a constant period a time.

Figure 10:
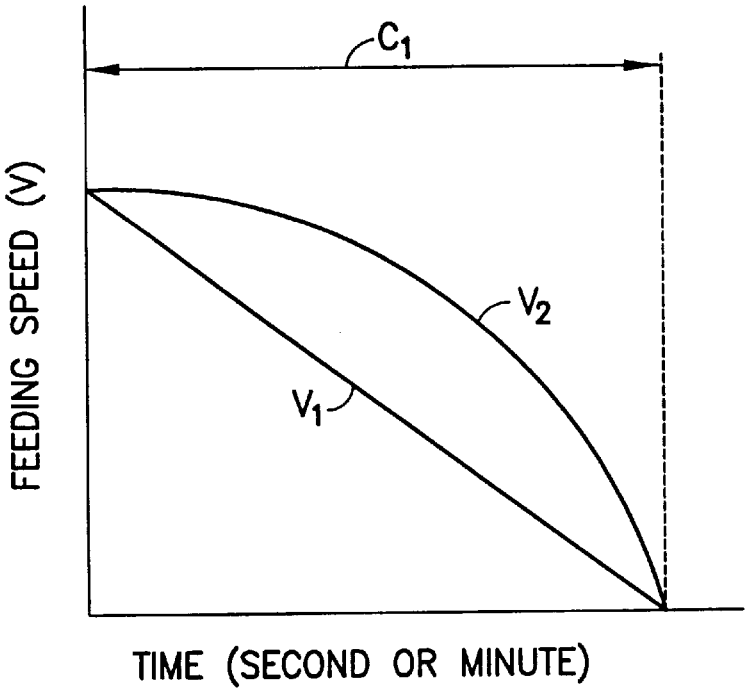
FIG. 10 is a graph showing the feeding speed of the cleaning fabric fed in one cleaning cycle.

There is further provided a method of cleaning the outer surface of the cylinder 2 by using the cleaning fabric 8 which is not intermittently but continuously fed from the supply roll 12, and engaged with and pressed against the outer surface of the cylinder 2. The method comprises the step of predetermining the feeding speed V of the cleaning fabric 8 engaged with the outer surface of the cylinder 2 so that the feeding speed V is gradually changed in a cleaning fabric, as shown in FIG. 10.

In a preferred embodiment, the feeding speed V is continuously changed in accordance with the progress of cleaning from start to end of the cleaning cycle C1 and continuously lowered at least in a portion of the cleaning cycle C1. Accordingly, the cleaning fabric 8 is made considerably dirty throughout the cleaning cycle C1. This decreases the length of the cleaning fabric 8 used in one cleaning cycle C1 and eliminates the waste of cleaning fabric 8 and cleaning agent or detergent.

The feeding speed V may be linearly lowered as shown by V1. The feeding speed V may be parabolically lowered as shown by V2. The feeding speed V may be temporarily increased at the middle of the cleaning cycle C1 and then lowered.

Figure 11:
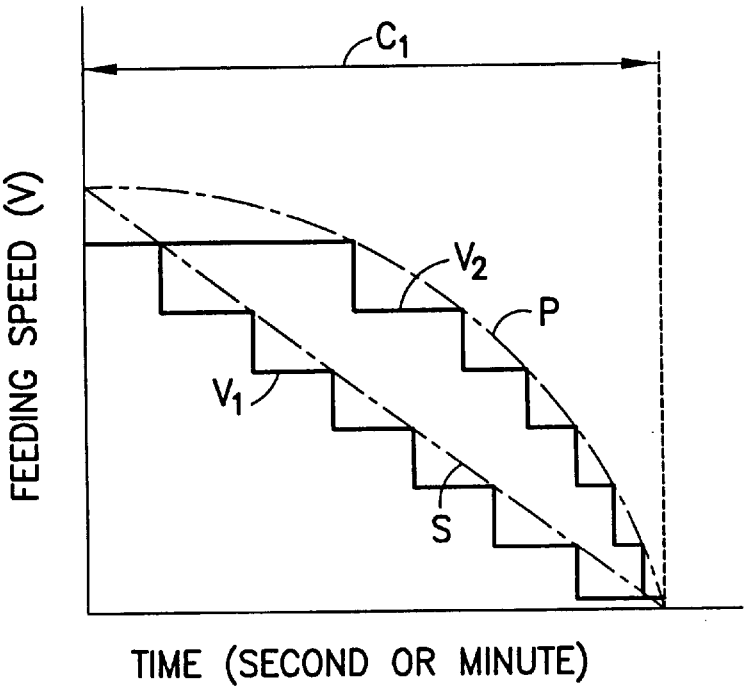
FIG. 11 is a graph showing the feeding speed of the cleaning fabric in another embodiment.

The feeding speed V may be changed step by step in accordance with the progress of cleaning from start to end of the cleaning cycle C1 and lowered step by step at least in a portion of the cleaning cycle C1 as shown in FIG. 11. The feeding speed V may be lowered step by step along a straight line S as shown by V1. The feeding speed V may be lowered step by step along a parabola P as shown by V2. The feeding speed V may be temporarily increased at the middle of the cleaning cycle C1 and then lowered.

Figure 12:
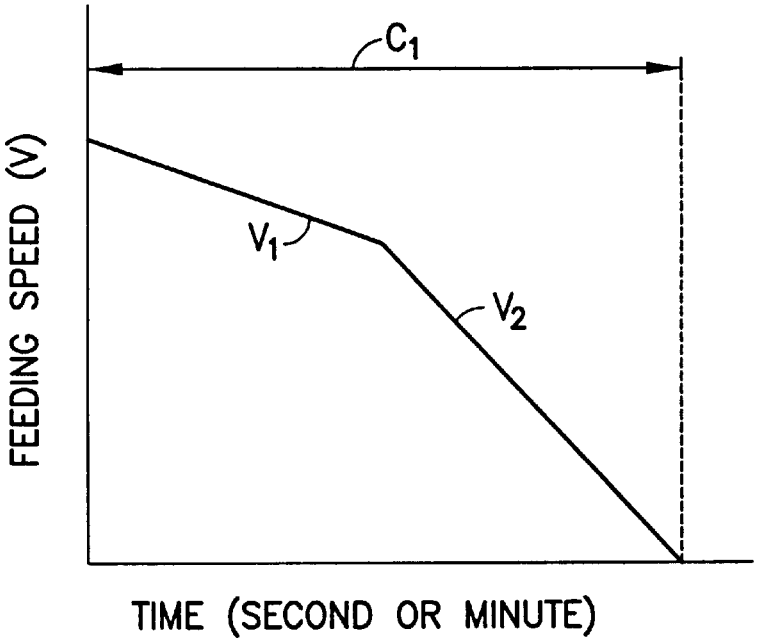
FIG. 12 is a graph showing the feeding speed of the cleaning fabric in other embodiment.

The feeding speed V may be lowered with a plurality of gradients which are increased in accordance with the progress of cleaning from start to end of the cleaning cycle C1, as shown in FIG. 12. For example, the feeding speed V may be firstly lowered with a gentle gradient as shown by V1 and then lowered with a steep gradient as shown by V2.

Figure 13:
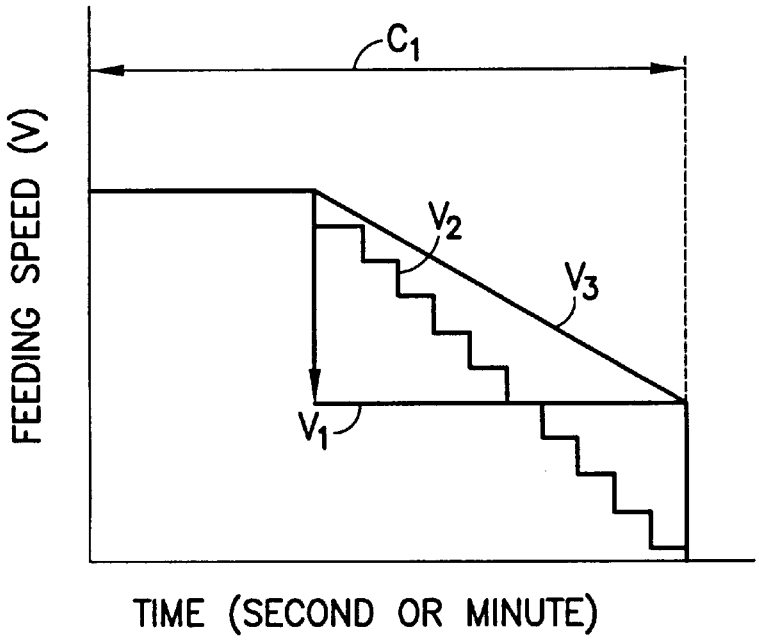
FIG. 13 is a graph showing the feeding speed of the cleaning fabric in other embodiment.

The feeding speed V may be increased with respect to a portion or the whole of the substantially first half in length of the cleaning fabric 8 used in the cleaning cycle C1 and lowered with respect to the residual of the cleaning fabric 8 used in the cleaning cycle C1, as shown in FIG. 13. For example, the feeding speed V may be high with respect to a portion or the whole of the substantially first half in length of the cleaning fabric 8 used in the cleaning cycle C1 and then changed to be low as shown by V1. The feeding speed V may be lowered step by step as shown by V2 or continuously lowered as shown by V3.

What is claimed is:

1. A method of cleaning an outer surface of a cylinder by using a cleaning fabric intermittently fed from a supply, said cleaning fabric being engaged with and pressed against the outer surface of the cylinder in a cleaning cycle, said method comprising:

predetermining periods, for each of which said cleaning fabric is engaged with said outer surface of the cylinder at one time, at least some of the periods being different in length from other periods in said cleaning cycle, wherein said periods are divided into a plurality of groups and lengthened, group by group, from start to end of said cleaning cycle.

2. A method of cleaning an outer surface of a cylinder by using a cleaning fabric intermittently fed from a supply, said cleaning fabric being engaged with and pressed against the outer surface of the cylinder in a cleaning cycle, said method comprising:

predetermining periods, for each of which said cleaning fabric is engaged with said outer surface of the cylinder at one time, at least some of the periods being different in length from other periods in said cleaning cycle, wherein said periods are divided into a plurality of groups, said cleaning fabric being intermittently fed at a number of times per unit of time, said number of times being decreased group by group from start to end of said cleaning cycle.

3. A method of cleaning an outer surface of a cylinder by using a cleaning fabric, comprising:

feeding said cleaning fabric intermittently fed from a supply, said cleaning fabric being engaged with and pressed against the outer surface of the cylinder by a pad, said cleaning fabric being nipped between said pad and said cylinder within a stripe range having a nip width in a feeding direction of said cleaning fabric; and predetermining a feeding length of said cleaning fabric which is less than said nip width of the cleaning fabric.

4. The method of claim 3 wherein said cleaning fabric has a cleaning agent or detergent impregnated into or applied onto said cleaning fabric.

5. The method of claim 3 wherein said cleaning fabric is engaged with said outer surface of the cylinder for a constant period at one time.

6. A method of cleaning an outer surface of a cylinder by using a cleaning fabric continuously fed from a supply at a feeding speed in a cleaning cycle, said cleaning fabric being engaged with and pressed against the outer surface of the cylinder, said method comprising:

predetermining the feeding speed of the cleaning fabric engaged with said outer surface of the cylinder so that the feeding speed is gradually changed in said cleaning cycle.

7. The method of claim 6 wherein said cleaning fabric has a cleaning agent or detergent impregnated into or applied onto the cleaning fabric.

8. The method of claim 6 wherein said feeding speed is changed in accordance with a progression of cleaning from start to end of the cleaning cycle and lowered during at least a portion of the cleaning cycle.

9. The method of claim 6 wherein said feeding speed is changed step by step in accordance with a progression of cleaning from start to end of the cleaning cycle and lowered step by step during at least a portion of the cleaning cycle.

10. The method of claim 6 wherein said feeding speed is lowered at a plurality of rates which are increased in accordance with a progession of cleaning from start to end of said cleaning cycle.

11. The method of claim 6 wherein said cleaning fabric is intermittently fed for a total feeding length in said cleaning cycle, said total feeding length being divided into first and second halves, and wherein said feeding speed is being increased with respect to at least a portion of the first half and lowered with respect to residual cleaning fabric used in the cleaning cycle.

* * * * *

UNITED STATES PATENT AND TRADEMARK OFFICE

CERTIFICATE OF CORRECTION

PATENT NO. : 6,042,655

DATED : March 28, 2000

INVENTOR(S) : Akira Hara et al.

It is certified that error appears in the above-identified patent and that said Letters Patent is hereby corrected as shown below:

On the title page, item [56],

IN THE REFERENCES CITED

Under "U.S. PATENT DOCUMENTS", add -- 4,765,242 8/1988 Oya et al. --.

IN THE CLAIMS

Claim 3, line 3, delete "feeding said cleaning fabric intermittently fed" and insert therefor -- intermittently feeding said cleaning fabric --.

Signed and Sealed this

Twentieth Day of February, 2001

*Attest:*

Nicholas P. Godici

NICHOLAS P. GODICI

*Attesting Officer*

*Acting Director of the United States Patent and Trademark Office*